United States Patent [19]

Tsuboi et al.

[11] 4,131,463

[45] Dec. 26, 1978

[54] ELECTRIC RECORDING PROCESS OF IMAGES USING ELECTRON SENSITIVE LAYER CONTAINING TRIVALENT COBALT COMPLEX AND COMPOUND HAVING CONJUGATED $\pi$ BOND SYSTEM

[75] Inventors: Masayoshi Tsuboi, Asaka; Yoshiaki Suzuki, Minami-ashigara; Masatoshi Tabei, Asaka, all of Japan

[73] Assignee: Fuji Photo Film Co., Ltd., Minami-ashigara, Japan

[21] Appl. No.: 834,736

[22] Filed: Sep. 19, 1977

[30] Foreign Application Priority Data

Sep. 17, 1976 [JP] Japan ..... 51-111515

[51] Int. Cl.[2] ..... G03G 17/02

[52] U.S. Cl. ..... 96/1 E; 96/1.1; 204/2; 204/4

[58] Field of Search ..... 96/1 E, 1.1; 204/2, 204/4, 5, 6, 8; 346/1

[56] References Cited

U.S. PATENT DOCUMENTS 3,898,672 8/1975 Yasumori et al. ..... 204/2

*Primary Examiner*—John D. Welsh

*Attorney, Agent, or Firm*—Sughrue, Rothwell, Mion, Zinn and Macpeak

[57] ABSTRACT

An image-recording material comprising a support, at least the surface of which is electrically conductive, having on the electric conductive surface a layer of an electron-sensitive composition substantially containing (a) a trivalent cobalt complex compound, (b) a compound having a conjugated $\pi$ bond system capable of forming at least a bidentate ligand with a divalent or trivalent cobalt ion, and (c) a film-forming organic high polymer, the electron-sensitive composition further containing (d) a compound capable of absorbing electromagnetic waves of a wavelength not longer than about 350 nm as an ultraviolet light absorbing agent, an image-recording process using the image-recording element and an apparatus for forming visible images using the image-recording material.

8 Claims, 4 Drawing Figures

ELECTRIC RECORDING PROCESS OF IMAGES USING ELECTRON SENSITIVE LAYER CONTAINING TRIVALENT COBALT COMPLEX AND COMPOUND HAVING CONJUGATED $\pi$ BOND SYSTEM

BACKGROUND OF THE INVENTION

1. Field of the Invention

The present invention relates to an image-recording material, an image-recording process and an apparatus therefor. More particularly, it relates to an image-recording material enabling visible images with a high optical density to be formed by energizing an image-recording layer containing a trivalent cobalt complex compound to form a latent image or a primitive visible image in the image-recording layer and developing the image-recording layer in a dry process; an image-recording process; and an apparatus therefor.

2. Description of the Prior Art

Of image-recording processes, particularly well known and excellent processes can be classified in a broad sense as photography, thermography, electrophotography, and combinations of two or more of these arts such as heat-sensitive photography. Additionally, the terms of photography, thermography and electrophotography as used in this specification mean image-recording processes. In these processes, light, heat and electrical phenomena are utilized, respectively, for recording and reproducing a pattern in a visible form. These known image-recording processes possess intrinsic advantages in particular uses but, in other uses, they have various defects limiting their utility. For example, conventional photography using a silver halide emulsion has the defect that a wet and chemical developing step is required, thermography requires heating a latent image, and one embodiment of electrophotography, xerography, requires a mechanical transfer of a powder pattern.

It is well known to form images in a recording layer of a specific recording material by passing a current in the interior of the recording layer thereof. For example, K. S. Lion et al. in "Investigation in the Field of Image Intensification, Final Report", *Air Force Cambridge Research Laboratory* (*AFCRL*), 64–138, Jan. 31, 1964, Contract No. AF 19(605) — 5704 discloses such a photographic process. In this recording material, an ordinary light-sensitive photographic emulsion layer is provided adjacent a photoconductive layer. A uniform electric field is applied across the photoconductive layer and the photographic layer and, at the same time, the photoconductive layer is imagewise exposed with a light pattern, followed by passing a current through the photographic layer in an image-wise manner.

The recording process of Lion et al, supra, has the advantage of an increase in sensitivity, but it has the defects resulting from the use of a light-sensitive layer which must be chemically developed. Further, since a latent image is formed in the conventional light-sensitive photographic emulsion, it is necessary to generate a substantial current flow in the photographic emulsion. Therefore, where the current is low, a comparatively long exposure time is necessary or, where the exposure time is short, a large current is necessary.

Another process for forming visible images is disclosed in U.S. Pat. No. 3,138,547. This process includes the use of a light-insensitive, electron-sensitive recording layer of reducible metal compound particles capable of being electrically reduced in development (in situ). This recording layer is provided on a support with an electrically conductive layer thereon, and recording is effected by contacting the layer with an electrically charged needle to generate a current flow in the recording layer. In this case, sufficient current to form a visible image by reducing a specific metal compound in a dry state is passed.

The defect of the above-described recording process disclosed in U.S. Pat. No. 3,138,547 is that image gain or amplification is not possible.

A further process is disclosed in U.S. Pat. Nos. 2,798,959 and 2,798,960. According to the disclosure of these patents, a photoconductive material and a heat-sensitive material are sandwiched between a pair of electrodes and, at the same time, they are brought into electric contact with these electrodes. An electric potential is applied across these electrodes, during which time an optical image is projected on the photoconductive material. By passing a current, the photoconductive material is heated according to the current. The heated image thus formed in the photoconductive material subsequently changes the heat-sensitive material to form a permanent image there.

One defect of this recording process of U.S. Pat. Nos. 2,798,959 and 2,798,960 is that it is necessary to pass a large current in the photoconductive material in order to supply enough heat energy to form an image. Further, just as is the case with the process of U.S. Pat. No. 3,138,547, in order to attain an increase in the density of the final image, the current must be increased.

An image-recording process including image amplification (or image intensification) is disclosed in U.S. Pat. No. 3,425,916. According to this process, a reagent layer is imagewise exposed to a comparatively small current to form chemically developable nuclei in the reagent layer. Then, the layer is subjected to chemical development for amplification, thus forming a visible image.

The process of U.S. Pat. No. 3,425,916 requires only a comparatively small current for forming a developable latent image. However, this process requires that a recording material to be used therefor be moistened during the latent image-forming step or nuclei-forming step. In addition, visible images formed through development must immediately be stabilized through washing and fixing just as in an ordinary photographic process. This process has not so far been commercially utilized for the above-described and other reasons.

SUMMARY OF THE INVENTION

The present invention thus provides, as embodiments thereof, (1) an image-recording process for recording images by using a recording material comprising a support, at least the surface of which is electrically conductive, with this electrically conductive surface having thereon an electron-sensitive composition layer substantially containing a trivalent cobalt complex compound, a compound (chelating agent) having a conjugated $\pi$ bond system capable of forming at least a bidentate ligand with a divalent or trivalent cobalt ion as an image-recording layer, which process involves the steps of:

(i) imagewise generating in the image-recording layer enough electric current to form a latent image; and (ii) reducing the trivalent cobalt complex compound in the area wherein the electric current has passed in the above-described step by substantially uniformly heating at least the image-recording layer;

(2) an image-recording process for recording images by using a recording material comprising a support, at least the surface of which is electrically conductive, with this electrically conductive surface having thereon an electron-sensitive composition layer substantially containing a trivalent cobalt complex compound, a compound having a conjugated $\pi$ bond system capable of forming at least a bidentate ligand with a divalent or trivalent cobalt ion, and a binder as an image-recording layer, which process involves the steps of:

(i) imagewise generating in the image-recording layer enough electric current to form a primitive visible image; and (ii) heating at least the image-recording layer to amplify the primitive visible image formed and increase the optical density;

(3) an image-recording process using a recording material as described in (1) or (2) above in which a photoelectric sensor is further provided on the surface of the image-recording layer; (4) an apparatus for forming a visible image using a heat-processable image-recording material comprising a support, at least the surface of which is electrically conductive, having on this electrically conductive surface an electron-sensitive composition layer substantially containing a trivalent cobalt complex compound, a compound having a conjugated $\pi$ bond system capable of forming a bidentate ligand with a divalent or trivalent cobalt ion, and a binder, including:

(i) supplying means for accepting a plurality of the image-recording materials;

(ii) a power supply containing stratified electrodes;

(iii) exposure means containing means for supporting the image-recording material, one side of which is electrically connected to the stratified electrodes, and means supported on the stratified electrodes for imagewise applying an electric current from the power supply to the image-recording layer electrically connected thereto;

(iv) processing means containing means for substantially uniformly heating at least the image-recording layer of the image-recording material;

(v) means for transferring the image-recording material from the supplying means to the exposure means and to the processing means; and (vi) control means for actuating the transferring means so as to feed the image-recording material from the supplying means to the exposure means and to the processing means and for actuating the electric current applying means and the heating means while the image-recording material is in the exposure means and the processing means respectively, which control means is electrically and mechanically connected to said transferring means;

(5) an image-recording material comprising a support having thereon an electron-sensitive composition layer substantially comprising (a) a trivalent cobalt complex compound, (b) a compound having a conjugated $\pi$ bond system capable of forming at least a bidentate ligand with a divalent or trivalent cobalt ion (hereinafter referred to as a chelating agent), (c) a film-forming organic high polymer (hereinafter referred to as a binder) compatible with components (a) and (b), and (d) a compound compatible with components (a), (b) and (c) and capable of absorbing electromagnetic waves of a wavelength shorter than about 350 nm (hereinafter referred to as a ultraviolet light-absorbing agent), the support being electrically conductive on the surface, or having an electrically conductive layer on the surface, or being totally electrically conductive (hereinafter referred to as an electrically conductive support); (6) a photoelectric image-recording material further having a photoelectric sensor layer (which means a photoelectric sensor in a layer form; hereinafter the term photoelectric sensor is used in this sense unless otherwise specified) in substantially uniform contact with the electron-sensitive composition layer in the image-recording material described in (5) above; (7) an image-recording process which primarily comprises imagewise irradiating (hereinafter referred to as imagewise exposing) a photoelectric sensor using electromagnetic waves of a wavelength shorter than about 1200 nm while uniformly contacting the photoelectric sensor with the electron-sensitive composition layer of the image-recording material described in (5) above or image-wise irradiating using the image-recording material described in (6) above and, simultaneously, applying an electric potential across the electrically conductive support and the photoelectric sensor with enough time for imagewise exposure and electric potential-application to imagewise pass an electrical current sufficient for forming a latent image or a primitive visible image in the electron-sensitive composition layer, heating the entire electron-sensitive composition layer after or without separating the photoelectric sensor to thereby reduce the trivalent cobalt complex compound in the areas of the layer where the latent or primitive visible image has been formed (coinciding with the areas in which the electrical current has been imagewise passed), thus forming a visible image with a high optical density corresponding to the latent or primitive visible image; (8) an image-recording process using the image-recording material described in (5) above, which primarily comprises bringing the surface of the electron-sensitive composition layer of the image-recording material into contact with an electrically conductive material having a specific image on the surface thereof or with an electrically conductive material having the form of a specific image, imagewise passing, across the electrically conductive material and the electrically conductive support in the image-recording material, enough current to form a latent image or a primitive visible image in the electron-sensitive composition layer, and subsequently heating in the same manner as described above to form a visible image; and (9) an apparatus for forming a visible image by using the image-recording material described in (6) above, including:

(i) supplying means for accepting a plurality of the image-recording materials;

(ii) a power supply containing stratified electrodes;

(iii) exposure means containing means for supporting the image-recording material, one side of which is electrically connected to the stratified electrodes, and means, supported on the stratified electrodes, for imagewise applying an electric current from the power supply to the image-recording layer electrically connected thereto;

(iv) processing means containing means for substantially uniformly heating at least the image-recording layer;

(v) means for transferring the image-recording material from the supplying means to the exposure means and to the processing means; and (vi) control means for actuating the transferring means so as to feed the image-recording material from the supplying means to the exposure means and to the processing means and for actuating the electric current applying means and the heating means while the image-recording material is in the exposure means and the processing means, respectively, which control means is electrically and mechanically connected to the transferring means.

Figure 1:
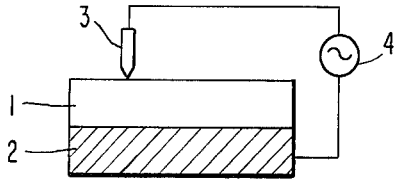
FIG. 1 is a schematic view showing the formation of a heat-developable latent image according to one embodiment of the present invention.

In these figures, numeral 1 designates an image-recording layer, 2 a support with at least the surface being electrically conductive, 3 a metal needle, 4 a source of electric power, 5 a heating plate, 6 a photoelectric translating element, 7 a transparent conductive support (6 and 7 in combination comprising a photoelectric sensor), 8 a DC power supply, 9 a switch, 0 an electrically conductive support, 10 a hopper, 11 a transfer member, 12 an exposure area, 13 a processing area, 14 a control circuit, 15 a feeding shelf, 16 a carrying roller, 17 a motor, 18 and 19 clutches, 20 and 21 separator rollers, 22 a conveyor belt, 23 and 28 microswitches, 24 and 29 microswitch contacts, 25 a switch, 26 an electric power supply, 27 a metal needle, 30 a heating means, 31 a reflection plate, 32 a receiving hopper, and 33 a driving logic apparatus.

DETAILED DESCRIPTION OF THE INVENTION

The term "dry development" as used in this specification means the procedure of substantially completely uniformly heating at least an image-recording layer without adding a chemical compound or element thereto. Such a procedure is conducted in a dry state from the beginning to the end.

The term "electron-sensitive material" as used in this specification means a material which undergoes a chemical and/or electrical change when a current is passed therethrough, resulting in the formation of a latent image or a primitive visible image.

The term "latent image" as used in this specification means an invisible image whose optical density can be amplified in the subsequent dry development step.

The term "primitive visible image" means a visible image with a low optical density in which the optical density can be amplified in the subsequent dry development step.

The optical density of the visible primitive image depends upon the total amount of electric current imagewise passed in an image-recording layer. The primitive visible image and the visible image are in such relation with each other that the optical density of the visible image is greater than that of the primitive visible image (usually within a range of from about two times to about 30 times).

Japanese Patent Application (OPI) No. 63,621/76 (corresponding to U.S. patent application Ser. No. 492,814, filed July 29, 1974) illustrates an electric charge-sensitive recording material capable of being developed in a dry process. This material contains at least (1) a reducible metal salt and (2) a reducing agent for the reducible metal salt.

On the other hand, the image-recording material of the present invention has an electron-sensitive layer containing at least (1) a reducible metal salt (i.e., a trivalent cobalt complex compound) and (2) a compound having a conjugated $\pi$ bond system capable of forming at least a bidentate ligand with a reduced metal salt (hereinafter referred to as a chelating agent). The electron-sensitive layer of the present invention does not contain the reducing agent for the metal salt disclosed in Japanese Patent Application (OPI) No. 63,621/76. This is a fundamental difference between the composition disclosed in Japanese Patent Application (OPI) No. 63,621/76 and that of the present invention. In addition, Japanese Patent Application (OPI) No. 63,621/76 involves the application of an electric potential as high as several kilovolts, whereas the image-recording process of the present invention enables a latent image or a primitive visible image to be formed by applying an electric potantial of only several volts. This is another difference existing between that of Japanese Patent Application (OPI) No. 63,621/76 and the present invention.

Trivalent cobalt complex compounds [hereinafter referred to as cobalt (III) complexes] are described in Japanese Patent Application (OPI) No. 139,724/75 (corresponding to U.S. Ser. No. 461,172, L filed Apr. 15, 1974). The cobalt (III) complexes to be used in the present invention are complexes which are characterized by a molecule with a cobalt atom or ion surrounded by atoms, ions or molecules coordinated therewith, hereinafter inclusively called ligands. The cobalt atom or ion at the center of these complexes is a Lewis acid, whereas the ligands are Lewis bases. As is known, in cobalt complexes the cobalt atom can be either divalent [cobalt (II) complexes] or trivalent [cobalt (III) complexes]. However, cobalt (III) complexes are used in the present invention, for the reason that, as compared with divalent cobalt complex compounds, in cobalt (III) complexes the cobalt atom or ion and the ligands are so strongly bonded that the complexes are inert to substitution reactions.

Preferred cobalt (III) complexes effective for the present invention are those which have a coordination number of 6. A wide variety of ligands can be used together with trivalent cobalt [hereinafter referred to as cobalt (III)] in order to form cobalt (III) complexes. Almost all Lewis bases (or materials with a lone electron pair) are suitable ligands for cobalt (III) complexes. Several typical and useful examples of ligands include halogen (e.g., chloro, bromo, fluoro, etc.), nitro, nitrito, nitrato, oxo, peroxo, aquo, amine (e.g., ethylenediamine, triethylenediamine, diethylenetriamine, triethylenetetramine, ethylenediaminetetraacetic acid, etc.), ammine, azido, oxalato, dipyridyl, phenanthrolinyl, glyoxinato, thiocyanato, carbonato, glycinato, phosphinato, cyano, similar ligands, and those described in F. Basolo & R. G. Pearson; *Mechanism of Inorganic Reactions, A Study of Metal Complexes in Solution,* 2nd. Ed. pp 44–46, John Wiley and Sons, Inc., New York (1967). Also, cobalt (III) complexes containing Schiff bases as a ligand described in, e.g., German Patent Application (OLS) Nos. 2,052,197 and 2,052,198 may be used.

The cobalt (III) complexes useful for the present invention can be electrically neutral compounds without anions or cations associated therewith. The cobalt (III) complexes may contain also one or more cations and anions such that electrical neutrality is achieved. Useful cations are those which form readily soluble cobalt (III) complexes, such as alkali metal (e.g., Li, Na or K) or quaternary ammonium cations (e.g., dimethylbenzylammonium chloride, trimethylammonium bromide, tetraethylammonium chloride, etc.).

Typical preferred cobalt (III) complexes, are illustrated below:

Hexamminecobalt (III) tribenzilate
Hexamminecobalt (III) trithiocyanate
Hexamminecobalt (III) tri(trifluoroacetate)
Chloropentamminecobalt (III) diperchlorate
Bromopentamminecobalt (III) diperchlorate
Aquopentamminecobalt (III) triperchlorate
bis(Ethylenediamine)bisazidocobalt (III) perchlorate
bis (Ethylenediamine)bisazidocobalt (III) perchlorate
Triethylenetetraminedichlorocobalt (III) trifluoroacetate bis(Methylamine)tetramminecobalt (III) tri(hexafluorophosphate)
Aquopenta(methylamine)cobalt (III) trinitrate
Chloropenta(ethylamine)cobalt (III) di(pentafluorobutanoate)
Trinitrotrisamminecobalt (III)
Trinitrotris(methylamine)cobalt (III)
tris(Ethylenediamine)cobalt (III) triperchlorate
tris(1,3-Propanediamine)cobalt (III) tri(trifluoroacetate) bis(Dimethylglyoximato)bispyridinecobalt (III) tri(trifluoroacetate
N,N-Ethylenebis(glycilideneimine)bisamminecobalt (III) triperchlorate
Aquobis(dimethylglyoximato)chlorocobalt (III) μ-Superoxodecaaminedicobalt (II) diperchlorate
Cobalt (III) tris(acetylacetonato)
Pentamminecarbonatocobalt (III) perchlorate tris(-Glycinato)cobalt (III)
trans[bis(Ethylenediamine)chlorothiocyanatocobalt (III)] perchlorate
trans[bis(Ethylenediamine)diazidocobalt (III)] thiocyanate
cis[bis(Ethylenediamine)ammineazidocobalt (III)] di(-trifluoroacetate)
tris(Ethylenediamine)cobalt (III) tribenzylate
trans[bis(Ethylenediamine)dichlorocobalt (III)]perchlorate
bis(Ethylenediamine)dithiocyanatocobalt (III) perfluorobenzoate
Triethylenetetraminedinitrocobalt (III) dichloroacetate
tris(Ethylenediamine)cobalt (III) trisalicylate
tris(2,2'-Bipyridyl)cobalt (III) triperchlorate
bis(Dimethylglyoximato)chloropyridinecobalt (III)
bis(Dimethylglyoximato)thiocyanatopyridinecobalt (III)

Compounds having a conjugated $\pi$ bond system (chelating agents) capable of forming at least a bidentate chelate with cobalt (II) and/or cobalt (III) are used. As is well known in this field, a conjugated $\pi$ bond system can easily be formed by the bonding of atoms such as carbon, nitrogen, oxygen and/or sulfur. Typical examples thereof include double bond-containing groups wherein the double bonds are positioned in a conjugated relationship, such as vinylene, azo, azinyl, imino, formimidoyl, carbonyl and/or tricarbonyl group. Various compounds are known in this field, containing a conjugated $\pi$ bond system capable of forming at least a bidentate ligand. Typical preferred examples of such chelating agents are nitrosoarols, (aromatic compounds having one nitroso group and one hydroxy group at adjacent positions), dithiooxamides, formazans, aromatic azo compounds, hydrazones, and Schiff bases.

Preferred nitrosoarol chelating agents are those wherein a nitroso group and a hydroxy group are connected to adjacent atoms of a ring (e.g., 2-nitrosophenol, 1-nitroso-2-naphthol, 2-nitroso-1-naphthol, etc.).

Preferred nitrosoarols are those which are defined by the following general formula (X);

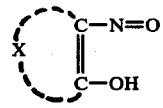

(X)

wherein X represents the atoms necessary for completing an aromatic nucleus (typically, a phenyl or naphthyl nucleus).

Dithiooxamide is also a preferred chelating agent. Further, dithiooxamide derivatives wherein one or both nitrogen atoms are substituted with an alkyl group, an alkylaryl group, an aryl group or an arylalkyl group are similarly preferred chelating agents.

Preferred dithiooxoamides are those which can form a tridentate chelate, such as those represented by the following general formula (XI);

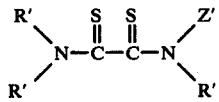

(XI)

wherein Z' represents a group capable of forming a chelate ligand, and each R', which may be the same or different, represents a member selected from, for example, Z', a hydrogen atom, an alkyl group, an alkylaryl group, an aryl group and an arylalkyl group.

Preferred aromatic azo compounds are those which can form at least a tridentate ligand with cobalt (III). Such aromatic azo compounds are defined by the following general formula (XII);

$$Z^2 - N = N - Z^3 \quad \text{(XII)}$$

wherein $Z^2$ and $Z^3$, which may be the same or different, each is selected from aromatic groups. All of these compounds can form a chelate ligand.

Preferred hydrazones capable of forming at least a tridentate chelate with cobalt (II) and/or cobalt (III) are those represented by the following general formula (XIII);

$$Z^4 - CH = N - NH - Z^5 \quad \text{(XIII)}$$

wherein $Z^4$ and $Z^5$, which may be the same or different, each is selected from aromatic groups. All of these compounds can form a chelate ligand.

Preferred Schiff bases capable of forming at least a tridentate chelate with cobalt (III) are those represented by the following general formula (XIV);

$$Z^6 - CH = N - Z^7 \quad \text{(XIV)}$$

wherein $Z^6$ and $Z^7$, which may be the same or different, each is selected from aromatic groups. All of these compounds can form a chelate ligand.

Ligand-forming aromatic substituents take the form of monocyclic or polycyclic carbon-containing or hetero atom-containing rings such as phenyl, naphthyl, anthryl, pyridyl, quinolyl, thiazolyl, benzothiazolyl, oxazolyl, benzoxazolyl, etc. In one form, this aromatic substituent is substituted with a substituent easily influencing the formation of a ligand (e.g., a hydroxy group, a carboxy group or an amino group) in a position adjacent the connecting position of the ring, thus showing a ligand-forming ability. In another form, this aromatic substituent is selected from N-hetero ring substituents in which a nitrogen atom of the ring is in a position adjacent the azo bond position, such as 2-pyridyl, 2-quinolinyl, 2-thiazolyl, 2-benzothiazolyl, 2-oxazolyl, 2-benzoxazolyl and like substituents. Of course, this aromatic substituent may be substituted with one or more substituents which do not prevent chelation, such as a lower alkyl group (having 1 to 6 carbon atoms), a benzyl group, a styryl group, a phenyl group, a biphenyl group, a naphthyl group, an alkoxy group (e.g., a methoxy group, an ethoxy group, etc.), an aryloxy group (e.g., a phenoxy group), an alkoxycarbonyl group (e.g., a methoxycarbonyl group, an ethoxycarbonyl group, etc.), an aryloxycarbonyl group, (e.g., a phenoxycarbonyl group, a naphthoxycarbonyl group, etc.), an acyloxy group (e.g., an acetoxy group, a benzoxy group, etc.), an acyl group (e.g., an acetyl group, a benzoyl group, etc.), a halogen atom (i.e., a fluorine atom, a chlorine atom, a bromine atom or an iodine atom), a cyano group, an azido group, a nitro group, a haloalkyl group (e.g., a trifluoromethyl group, a trifluoroethyl group, etc.), an amino group (e.g., a dimethylamino group, etc.), an amido group (e.g., an acetamido group, a benzamido group, etc.), an ammonium group (e.g., a trimethylammonium group, etc.), an azo group (e.g., a phenylazo group, etc.), a sulfonyl group (e.g., a methylsulfonyl group, a phenylsulfonyl group, etc.), a sulfoxy group (e.g., a methylsulfoxy group, etc.), a sulfonium group (e.g., a dimethylsulfonium group, etc.), a silyl group (e.g., a trimethylsilyl group, etc.), and an arylthio or alkylthio group (e.g., a methylthio group, etc.).

In general, the alkyl groups and alkyl moieties of the chelating agents have 20 or less carbon atoms, most preferably 6 or less carbon atoms. Aryl substituents and substituent moieties of the chelating agents are preferably phenyl or naphthyl groups.

Typical examples of chelating agents are illustrated below:

1-(2-Pyridyl)-3-phenyl-5-(2,6-dimethylphenyl)formazan
1-(2-Pyridyl)-3-hexyl-5-phenyl-2H-formazan
1-(2-Pyridyl)-3,5-diphenylformazan
1-(Benzothiazol-2-yl)-3,5-diphenyl-2H-formazan
1-(2-Pyridyl)-3-phenyl-5-(4-chlorophenyl)formazan
1,1'-Di(thiazol-2-yl)-3,3'-diphenylene-5,5'-diphenylformazan
1,3-Dodecyl-5-di-(benzothiazol-2-yl)formazan
1-Phenyl-3-(3-chlorophenyl)-5-benzothiazol-2-yl)formazan
1,3-Cyano-5-di(benzothiazol-2-yl)formazan
1-Phenyl-3-propyl-5-(benzothiazol-2-yl)formazan
1,3-Diphenyl-5-(4,5-dimethylthiazol-2-yl)formazan
1-(2-Pyridyl)-3,5-diphenylformazan
1-(2-Quinolinyl)-3-(3-nitrophenyl)-5-phenylformazan
1-(2-Pyridyl)-3-(4-cyanophenyl)-5-(2-tolyl)formazan
1,3-Naphthalenebis{3-[2-(pyridyl)-5-(3,4-dichlorophenyl)-formazan]}
1-(2-Pyridyl)-5-(4-nitrophenyl)-3-phenylformazan
1-(Benzothiazol-2-yl)-3,5-di(4-chlorophenyl)formazan
1-(Benzothiazol-2-yl)-3-(4-isophenyl)-5-(3-nitrophenyl)-formazan
1-(Benzothiazol-2-yl)-3-(4-cyanophenyl)-5-(2-fluorophenyl)-formazan
1-(4,5-Dimethylthiazol-2-yl)-3-(4-bromophenyl)-5-(3-trifluorophenyl)formazan
1-(Benzoxazol-2-yl)-3,5-diphenylformazan
1-(Benzoxazol-2-yl)-3-phenyl-5-(4-chlorophenyl)formazan
1,3-Diphenyl-5-(2-pyridyl)formazan
1-(2,5-Dimethylphenyl)-3-phenyl-5-(2-pyridyl)formazan
1-(2-Pyridyl)-3-(4-cyanophenyl)-5-(2-tolyl)formazan
1-(2-Benzothiazolyl)-3-phenyl-5-(8-quinolyl)formazan
1-(4,5-Dimethylthiazol-3-yl)-3-(4-bromophenyl)-5-(3-trifluoromethylphenyl)formazan
1,3-Diphenyl-5-(benzothiazol-2-yl)formazan
1-(Benzoxazol-2-yl)-3-phenyl-5-(4-chlorophenyl)formazan
1,3-Diphenyl-5-(2-quinolinyl)formazan
1-Phenylazo-2-phenol
1-Phenylazo-4-dimethylamino-2-phenol
2-Hydroxyphenylazo-2-phenol
1-(2-Hydroxyphenylazo)-2-naphthol
1-(2-Pyridylazo)-2-naphthol
1-(2-Pyridylazo)-2-phenol
4-(2-Pyridylazo)-resorcinol
1-(2-Quinolylazo)-2-naphthol
1-(2-Thiazolylazo)-2-naphthol
1-(2-Benzothiazolylazo)-2-naphthol
1-(4-Nitro-2-thiazolylazo)-2-naphthol
4-(2-Thiazolylazo)resorcinol
2,2-Azodiphenol
1-(3,4-Dinitro-2-hydroxyphenylazo)-2,5-phenylenediamine
1-(2-Benzothiazolylazo)-2-naphthol
1-(1-Isoquinolylazo)-2-naphthol
2-Pyridinecarboxyaldehydo-2-pyridylhydrazone
2-Pyridinecarboxyladehydo-2-benzothiazolylhydrazone
2-Thiazolcarboxyaldehydo-2-benzoxazolylhydrazone
2-Pyridinecarboxyaldehydo-2-quinolylhydrazone
1-(N-2-Pyridylformimidoyl)-2-naphthol
1-(N-2-Quinolinylformimidoyl)-2-naphthol
1-(N-2-Thiazolylformimidoyl)-2-naphthol
1-(N-2-Benzoxazolylformimidoyl)-2-phenol
2-(N-2-Pyridylformimidoyl)phenol
2-(N-2-Pyridylformimidoyl)pyridine
1-(N-2-Pyridiylformimidoyl)isoquinoline
2-[N-2-(4-nitropyridylformimidoyl)]thiazole
2-(N-2-Benzoxazolylformimidoyl)oxazole
1-Nitroso-2-naphthol
2-Nitroso-1-naphthol
1-Nitroso-3,6-disulfo-2-naphthol
Disodium 1-nitroso-2-naphthol-3,6-disulfonate
4-Nitrosoresorcinol
2-Nitroso-4-methoxyphenol
N-(2-Pyridyl)dithiooxamide
N,N-Di(2-pyridyl)dithiooxamide
N-(2-Benzothiazolyl)dithiooxamide
N-(2-Quinol)inyl)dithiooxamide
N,N-Dimethyldithiooxamide The compounds capable of absorbing electromagnetic waves having a wavelength shorter than about 350 nm which can be used in the present invention (i.e., ultraviolet light absorbing agents) are a compound or a mixture of two or more compounds selected from 2-hydroxybenzophenones, 2-(2-hydroxyphenyl)benzotriazoles, phenylsalicylate, resorcinol monobenzoic acid ester, α-cyano-β,β-diphenylacrylic acid, derivatives thereof substituted with a substituent or substituents which cannot substantially become anions, and dibenzoylresorcinols. Substituents which cannot substantially become anions mean those substituents other than substituents which can become anions (e.g., a carboxy group, a sulfonic acid group, a sulfoamino group, a sulfino group, a sulfeno group, a phosphono group, a selenono group, a selenino group, a hydroxy(thiocarboxyl) group, a mercaptocarbonyl group, etc.) and other substituents having these groups as secondary substituents. Substituents which do not form ions or which form cations can be suitably used in this invention.

2-Hydroxybenzophenone derivatives having a substituent or substituents which cannot substantially become anions are the compounds represented by the following general formula (I);

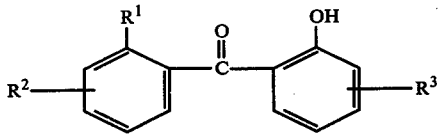

(I)

wherein $R^1$ represents a hydrogen atom or a hydroxy group, $R^2$ and $R^3$, which may be the same or different, each represents a hydrogen atom, a halogen atom (e.g., a fluorine atom, a chlorine atom, a bromine atom or an iodine atom) or an —$OR^4$ group. $R^4$ represents a hydrogen atom or a straight-chain, branched-chain or cyclic alkyl group having 1 to 21 carbon atoms (e.g., a methyl group, an ethyl group, a propyl group, a butyl group, an amyl group, an octyl group, an octadecyl group, an isopropyl group, an iosamyl group, a sec-butyl group, a sec-pentyl group, a tert-butyl group, a tert-pentyl group, a cyclopentyl group, a cyclohexyl group, a 2-norbornyl group, etc.).

2-(2-Hydroxyphenyl)benzotriazole derivatives having a substituent or substituents which cannot substantially become anions are the compounds represented by the following general formula (II);

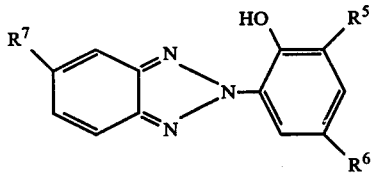

(II)

wherein $R^5$ and $R^6$, which may be the same or different, each represents a hydrogen atom or a straight-chain, branched-chain or cyclic alkyl group having 1 to 12 carbon atoms (e.g., a methyl group, an ethyl group, a propyl group, a butyl group, an amyl group, an octyl group, a nonyl group, a dodecyl group, an isopropyl group, an isoamyl group, a sec-butyl group, a sec-pentyl group, a tert-butyl group, a tert-pentyl group, a cyclopentyl group, a cyclohexyl group, a 2-norbornyl group, etc.), and $R^7$ represents a hydrogen atom or a halogen atom (e.g., a fluorine atom, a chlorine atom or bromine atom).

Phenyl salicylate derivatives having a substituent or substituents not substantially capable of becoming anions are the compounds represented by the following general formula (III);

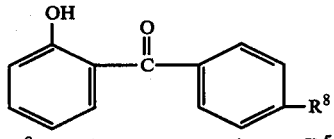

(III)

wherein $R^8$ has the same meaning as $R^5$.

Resorcinol monobenzoic acid ester derivatives having a substituent or substituents not substantially capable of becoming an anion are the compounds represented by the following general formula (IV);

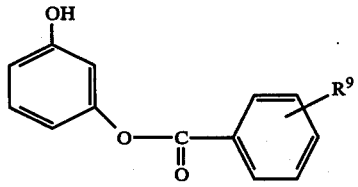

(IV)

wherein $R^9$ has the same meaning as $R^5$ (except for a hydrogen atom).

α-Cyano-β,β-diphenylacrylic acid derivatives having a substituent not substantially capable of becoming an anion are the α-cyano-β,β-diphenylacrylic acid esters with or without a substituent not substantially capable of becoming an anion represented by the following general formula (V) and the derivatives thereof;

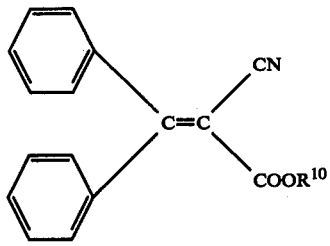

(V)

wherein $R^{10}$ has the same meaning as $R^5$ (except for a hydrogen atom).

Dibenzoylresorcinols are the compounds represented by the following general formula (VI);

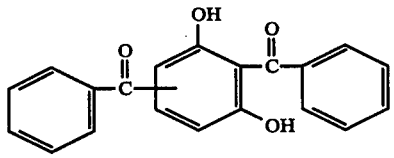

(VI)

Specific examples of suitable ultraviolet light-absorbing agents which can be used in this invention are illustrated below:

2-(2-Hydroxy-5-methylphenyl)benzotriazole
2-(2-Hydroxy-3,5-di-tert-butylphenyl)-6-chlorobenzotriazole
2-(2-Hydroxy-3-tert-butyl-5-methylphenyl)-6-chlorobenzotriazole
2-(2-Hydroxy-3-tert-butylphenyl)benzotriazole 4-tert-Butylphenyl salicylate
Phenyl salicylate
p-Octylphenyl salicylate
Resorcinol Monobenzoate
2,4-Dibenzoylresorcinol
2-Hydroxy-4-octadecyloxy-benzophenone
2,2'-4,4'-Tetrahydroxybenzophenone
2-Hydroxybenzophenone
2,2-Dihydroxybenzophenone
2-Hydroxy-4-methoxybenzophenone
2-Hydroxy-4-octyloxybenzophenone
2,2'-Dihydroxy-4-methoxybenzophenone
5-Chloro-2-hydroxybenzophenone
2,4-Dihydroxybenzophenone
2,2'-Dihydroxy-4,4'-dimethoxybenzophenone
2,2',4,4'-Tetrahydroxybenzophenone
2-Hydroxy-4-(2-hydroxy-3-methacryloyloxy)propoxybenzophenone
1,1-Diphenyl-2-cyano-2-ethoxycarbonylethylene
1,1-Diphenyl-2-cyano-2-hexyloxycarbonylethylene.

Where ultraviolet light absorbing agents having a substituent or substituents which can become anions are employed, electron conduction is difficult. This results in reducing the electronic sensitivity. Thus, ultraviolet light absorbing agents having a substituent or substituents which substantially cannot become anions are employed. In contrast to this, ultraviolet light absorbing agents having a substituent or substituents which can substantially become cations do not increase the electric resistance very much, and such ultraviolet light absorbing agents can be employed. Examples of substituents which can become cations are those with the general formula $—NR^{11}R^{12}$ wherein $R^{11}$ and $R^{12}$, which may be the same or different, each represents a hydrogen atom, an alkyl group (e.g., methyl, ethyl, propyl, butyl, isopropyl, isobutyl, etc.), an aryl group (e.g., phenyl, tolyl, ethylphenyl, xylyl, etc.) or an aralkyl group (e.g., benzyl, phenethyl, etc.).

The compounds represented by the foregoing general formulae (I) to (VI) must be soluble in solvents which dissolve the trivalent cobalt complexes and the chelating agents. Also the ultraviolet light-absorbing agents must not have an anionizable substituent or substituents. Because, ultraviolet light absorbing agents having anionizable substituents form insoluble compounds with a trivalent cobalt complex, and the electric resistance of the electron-sensitive composition layer becomes so high that the electronic sensitivity of the image-recording material is reduced. The ultraviolet light-absorbing agents in Examples 13 and 14, given hereinafter, have an ionizable $—SO_3H$ group, and hence they form insoluble precipitates. Thus, the optical density of the fog formed with the lapse of time is markedly reduced, but the image density is also reduced. Thus, they are not preferred.

Electronic sensitivity is defined as the necessary electronic charge amount for obtaining a transmission optical density greater than that of non-energized areas of the electron-sensitive composition layer by 0.1 by conducting electrons and heat-developing a recording material.

Since light fog is generated upon exposure to ultraviolet light having a wavelength shorter than 350 nm, ultraviolet light-absorbing agents which have an absorption band in the wavelength region shorter than 350 nm are effective. Of these, those which do not have an absorption band in the visible region (e.g., a wavelength range of about 400 nm to about 700 nm) are most advantageous as ultraviolet light-absorbing agents.

The amount of ultraviolet light-absorbing agent which is contained in the electron-sensitive composition will vary depending upon the molecular extinction coefficient to ultraviolet light of the compound to be used as an ultraviolet light-absorbing agent. In general, the amount ranges from about $1 \times 10^{-6}$ mol to about $3 \times 10^{-4}$ mols, preferably, from about $5 \times 10^{-6}$ mols to about $1 \times 10^{-4}$ mol, per $m^2$ of the electron-sensitive composition layer of the image-recording material of the present invention. If the amount of the ultraviolet light-absorbing agent in the electron-sensitive composition is smaller than about $1 \times 10^{-6}$ mol, ultraviolet light which should be absorbed by the ultraviolet light-absorbing agent is not effectively absorbed as a matter of course, and hence light fog is formed in the non-image areas of the electron-sensitive composition layer of the image-recording material and the optical density in the background area gradually increases. Thus results in a small contrast in the image areas, and the images are difficult to discriminate. On the other hand, if the amount of the ultraviolet light-absorbing agent is greater than about $3 \times 10^{-4}$ mols, the electric resistance of the electron-sensitive composition layer increases, and hence, upon imagewise exposure while energizing the image-recording material, a long time is required to obtain the necessary exposure amount for forming an image in the electron-sensitive composition layer, or the optical density is difficult to increase due to the addition of the ultraviolet light-absorbing agent, resulting in the energizing time being prolonged to a practically impossible degree.

Examples of the molecular extinction coefficients (in the range of from about $10^3$ to about $2 \times 10^4$) of ultraviolet light-absorbing agents which can be used in the present invention are illustrated below.

2,4-Dihydroxybenzophenone (solvent: methyl alcohol; absorption maximum wavelength: 325 nm); molecular extinction coefficient $= 7.1 \times 10^3$ 2-Hydroxy-5-methylphenylbenzotriazole (solvent: methyl alcohol; absorption maximum wavelength; 336 nm); molecular extinction coefficient $= 1.24 \times 10^4$ It has been confirmed that light fog of the image-recording material of the present invention can be reduced, if the transmission optical density of the electron-sensitive composition layer of the material of the present invention is increased, by 0.2 or more, than that of an ultraviolet light-absorbing agent-free layer by incorporating the ultraviolet light-absorbing agent in the electron-sensitive composition. Additionally, under usual conditions, it may be possible to consider that ultraviolet light causing light fog in the image-recording material of the present invention contains ultraviolet light with a wavelength longer than about 250 nm including sunlight, a mercury lamp, an arc lamp, a fluorescent lamp, a xenon discharge lamp, etc. Therefore, the absorption wavelength band of the ultraviolet light-absorbing agents to be used in the present invention satisfactorily ranges from about 250 nm to about 350 nm.

The electron-sensitive composition to be used in the material of the present invention can contain various binders, in particular polymer binders also known as vehicles. Incorporation of such a binder in the electron-sensitive composition is preferred in many cases. Effective polymer binders may be either hydrophobic or hydrophilic. Examples of suitable binders include both naturally occurring materials represented by proteins, such as gelatin, gelatin derivatives, cellulose derivatives, polysaccharides (e.g., dextran, etc.), gum arabic, and synthetic polymers such as water-soluble polyvinyl compounds (e.g., polyvinyl pyrrolidone, acrylamide polymer, etc.). Other effective synthetic polymer compounds include dispersed vinyl compounds in the form of, for example, a latex, and particularly those which improve dimensional stability of the image-recording materials. Preferred polymers include water-insoluble polymers of alkyl acrylates, methacrylates, acrylic acid, sulfoalkyl acrylates and methacrylates, those which have cross-linking groups accelerating hardening or curing, and those which have sulfobetaine repeating units as described in Canadian Pat. No. 774,054. Particularly effective polymers include polycarbonates, polyvinyl formal, polyvinyl butyral, cellulose acetate butyrate, polymethyl methacrylate, polyvinyl pyrrolidone, ethyl cellulose, polystyrene, polyvinyl chloride, chlorinated rubber, polyisobutylene-butylenestyrene copolymers, vinyl chloride-vinyl acetate copolymers, vinyl acetate-vinyl chloride-maleic acid copolymers and polyvinyl alcohol. Selection of the most suitable polymer for the image-recording material of the present invention depends upon the properties of the electron-sensitive composition, the properties of the cobalt (III) complex, the properties of the chelating agent, the properties and use of the image-recording material, the processing conditions therefor, etc. It is important here that the binder should not detrimentally influence the desirable properties of the electron-sensitive composition. Useful polymer binders are described in, e.g., Japanese Patent Application (OPI) No. 63,621/76. Further, as the compound capable of accelerating the passage of an electric current through the image-recording layer upon energization (i.e., imagewise passing an electric current), a conductivity-increasing agent can be added. Examples of such an agent include amides (e.g., dimethylstearamide, dimethylolamide, etc.), esters (e.g., dibutyl phthalate, tricresyl phosphate, dimethyl phthalate, etc.), and alcohols (e.g., dodecyl alcohol, hexadecyl alcohol, hexyl alcohol, stearyl alcohol, etc.).

The electron-sensitive composition layer of the image-recording material to be used in the specific examples of the present invention can be provided on a wide variety of supports. Suitable supports include a cellulose nitrate film, a cellulose ester film, a polyvinyl acetate film, a polystyrene film, a polyethylene terephthalate film, a polycarbonate film, a sheet material of glass or metals, paper, etc. However, if the support is composed of an electrically insulating material, an electrically conductive layer must be provided between the support and the electron-sensitive composition layer as one member of the recording material.

Examples of suitable electrically conductive layers are tin oxide ($SnO_2$), indium oxide ($In_2O_3$), nickel, chromium, palladium, nickel-chromium alloy, aluminum, copper, iron, etc. and these layers can be provided using known processes such as vacuum deposition, sputtering, spray coating, and the like.

In this specification, the above-described electrically conductive supports and supports having an electrically conductive layer thereon are inclusively referred to herein merely as supports. The term "electrical conductivity" or "electrically conductive" as used herein means a specific resistance of about $10^6$ Ωcm or less, preferably about $10^5$ Ωcm.

Usually, flexible supports, in particular paper or polyester supports, are used. On this support can be coated baryta and/or a solvent-repellent layer. (More specifically, the term "solvent-repellent layer" means a layer which functions as a physical barrier for solvents). The polyester film may be coated with a subbing layer, or the surface thereof may be modified by corona discharge or flame treatment.

The electron-sensitive composition layer may contain a plasticizer and/or a lubricant, a surface active agent, a matting agent, etc.

The various components of the electron-sensitive composition layer to be used in the present invention are mixed with an aqueous solution or a suitable organic solvent solution depending upon the properties of the image-recording material to prepare a coating solution. Such components can be added utilizing various techniques known in the photographic field.

Suitable examples of organic solvents which can be used include alkanols such as methanol, ethanol, propanol, butanol, isopropyl alcohol, isoamyl alcohol, etc.; aromatic hydrocarbons and alkyl substituted aromatic hydrocarbons such as benzene, toluene, xylene, ethylbenzene, etc.; halogenated hydrocarbons such as 1,1-dichloroethane, 1,2-dichloroethane, 1,1,1-trichloro ethane, perchloroethane, chloroform, carbon tetrachloride, etc.; ketones such as dimethyl ketone, methyl ethyl ketone, methyl isobutyl ketone, diisobutyl ketone, cyclohexanone, etc.; carboxylic acid esters such as methyl acetate, ethyl acetate, butyl acetate, etc.; ethers, cyclic ethers and alkoxycarbonylalkylethers such as dimethyl ether, diethyl ether, tetrahydrofuran, dioxane, Cellosolve acetate, ethyl Cellosolve acetate, etc.; and other solvents such as N,N-dimethylformamide, dimethyl sulfoxide, N-methylpyrrolidone, etc.

The electron-sensitive composition layer of the image-recording material to be used in the present invention can be coated using various techniques known in the photographic field. For example, known techniques include a dip-coating process, an air knife-coating process, a cast-coating process and an extrusion coating process using a hopper of the type described in U.S. Pat. No. 2,681,294. If desired, two or more layers may be coated at the same time using processes known in this technical field. A suitable coating amount of the cobalt (III) complex is about $1 \times 10^{-7}$ mol/dm$^2$ to about $1 \times 10^{-3}$ mol/dm$^2$, preferably about $1 \times 10^{-6}$ mol/dm$^2$ to about $1 \times 10^{-4}$ mol/dm$^2$. A suitable amount of the binder and the chelating agent per mole of the cobalt (III) complex ranges from about 100 g to about 10,000 g and about 0.1 mol to about 50 mols, preferably 0.5 mol to 10 mols, respectively. A suitable thickness of the electron-sensitive composition layer is about 1 μm to about 20 μm, preferably 2 μm to 15 μm.

Since the image-recording material of the present invention is not very sensitive to visible light, it can be handled and developed under room light, and it also enables images to be recorded using various types of electromagnetic radiations having a wavelength varying over a wide range by appropriately selecting a photoelectric sensor. Further, it is also possible to expose using one or more different types of radiation by appropriately selecting the photoelectric sensor; for example, to selectively function as the recording step in the case of exposing using visible light in the presence of X-rays.

A photoelectric sensor to be used in the present invention is one which is rendered photoconductive upon irradiation with electromagnetic waves having a wavelength shorter than 1200 nm but higher than about 300 nm and which is in the form of a layer and is defined as a photoelectric sensor layer. The photoelectric effect can also be obtained using X-rays, whereby the electric conductivity is increased. The term photoelectric sensor is used herein in the sense of a photoelectric sensor layer unless otherwise sepcified.

The photoelectric sensor requires a photoconductive material and an electrically conductive layer provided in contact with the photoconductive material and, in some cases, a support is required. $\beta$-$Ag_2S$, $Cu_2O$, CuI, ZnO, ZnS, ZnSe, CdS, CdSe, PbS, $Sb_2S_3$, $Bi_2S_3$, $In_2Te_3$, GeS, GeSe, $Tl_2S$, GaAs, PbO, InP, Si, Ge, etc. can be used as the photoconductive material.

These photoconductive materials are used as elements in the form of single crystals, polycrystals or amorphous materials. In some cases, it is possible to disperse fine crystals in a polymer and provide as a layer on the support with an electrically conductive layer to thereby prepare the element. Also, it is possible to provide an electrically conductive layer on the support and form a thin film of the photoconductive material using a vacuum deposition process, an ion-plating process, a sputtering process, etc. The thickness of the photoconductive material layer (i.e., photoelectric sensor layer) can range from about 30 nm to about 10 mm.

The element having these photoconductive materials in a layer form further includes an electrically conductive layer. The electrically conductive layer can comprise a layer of $In_2O_3$, Au, Ag, $SnO_2$, Pt, Pd, etc., and such can substantially transmit visible light having a wavelength of from about 400 nm to about 700 nm therethrough.

In some cases, a slight amount of a foreign material is added to the photoconductive material of the photoelectric sensor in order to increase the photoconductivity. This effective foreign material added in a slight amount varies depending upon the photoconductive material. To illustrate several examples, Ag(I), Cu(I), etc. which are Group (I) elements are effective foreign materials to be added in a slight amount where the photoconductive materials are Group (II) to (IV) compounds such as ZnS, CdS, CdTe, etc.

Where the combination of the photoconductive material layer and the electrically conductive layer as described above is not self-supporting, a support is employed. Suitable supports are glass, quartz, polyethylene terephthalate film, polyimide film, cellulose acetate film, polypropylene film, etc.

The material and the process of the present invention include the two embodiments: one being the material wherein the above-described photoelectric sensor is previously provided closely on the electron-sensitive composition layer (image-recording layer) of the image-recording material; and the other being the material which is used by closely contacting, upon imagewise exposure, the above-described photoelectric sensor on the image-recording layer.

In the process of the present invention, it is possible to separate the photoelectric sensor from the image-recording material or the photoelectric image-recording material after imagewise exposure, and conduct development in a dry process, and it is also possible to conduct development in a dry process while the photoelectric sensor is in contact with the image-recording layer.

Heating of the image-recording material of the present invention or at least the image-recording layer can be attained using many known processes. In the process of the present invention, the image-recording material or at least the entire image-recording layer thereof may be substantially uniformly heated, or only particular areas may be heated. In this case, known processes which can be used include, e.g., placing the image-recording material on a heating plate, guiding the image-recording material between heating rollers, and applying radiated energy emitted from a heating lamp, a microwave apparatus or from an ultrasonic wave apparatus.

In the image-recording material of this invention, the cobalt (III) complex is imagewise-reduced to form a cobalt (II) complex. At the region of the electron-sensitive composition layer where an electric current is passed, a thermally developable latent image is formed. The latent image reduces the cobalt (III) complex during the thermal development to form the cobalt (II) complex.

Temperatures effective for forming the desired developed images generally range from about 50° C. to about 200° C., preferably from about 60° C. to about 140° C. The optimum temperature range is selected depending on several factors such as the desired image, the components of the particular image-recording material, etc. The time required for conducting the heating generally ranges from about 0.1 second to about 120 seconds. This varies, as described above, within the above-described range depending on the properties of the image-recording material and, more significantly, the form of the heating apparatus to be used. The heating is generally conducted at atmospheric pressure but, if desired, superatmospheric pressure or subatmospheric pressure may also be employed.

Upon heating the image-recording material, the trivalent cobalt complex reacts with the chelating agent in the latent image area or the primitive visible image area, and thus the cobalt complex is converted to a corresponding cobalt chelate compound. The thus formed chelate compound visually reproduces the previously applied electric current, i.e., a visiual image is formed. In this case, the strength of the applied electric current varies depending upon the electric current density formed in the photoelectric sensor.

The process of the present invention possesses many advantages as compared with known image-recording systems. More specifically, both the image-forming step and the developing step are conducted in a dry manner. Therefore, from the users' standpoint, the process of this invention is clearer, simpler and more advantageous than the image-recording system wherein at least the image-recording layer is moisture-conditioned or dampened during the image-recording step and/or the developing step. Further, the image-recording process of the present invention has the advantage that, even when the image-recording material is left in a room after development, extremely reduced light fog occurs.

In the case of developing a latent image or a primitive visible image, heat energy is uniformly applied to the entire image-recording material rather than imagewise applying heat energy as is conducted in known heat-sensitive electrophotography. Therefore, this developing step can be conducted rapidly and simply.

Another advantage is that a low-sensitivity image-recording material of the present invention can be produced, if desired.

Various devices can be used in order to control the passage of an electrical current in the image-recording material of the present invention. Examples of such devices include a stencil, needle or screen to which an electric potential is applied, in addition to the above-described photoelectric sensor. Specific examples of suitable devices which can be used are described in Japanese Patent Application (OPI) No. 63,621/76 (corresponding to U.S. Ser. No. 492,814, filed July 29, 1974)

The photoelectric sensor is particularly advantageous for controlling the electric current flow, since it is a photoelectric translating element. Therefore, various light sources can be used for exposure by appropriately selecting the photoelectric sensor. Suitable light sources of exposure include, for example, a tungsten lamp, a xenon lamp, a helium-neon laser beam, infrared light and X-rays. Any radiation source can be used as the light source for exposure as long as the photoelectric sensor responds to the radiation emitted therefrom. However, in this case, too, the operating resistance of the photoelectric sensor should not differ greatly from that of the image-recording material within the range of the operating voltage used in the present invention.

According to the present invention, various effective image-recording materials can be obtained. Optimum image-recording materials can be selected based on, for example, factors such as the images desired, the scope of processing conditions and the electric current sensitivity of the material.

According to the present invention, a negative image can be obtained from an original of positive image. The image-recording layer of the present invention does not contain a photo-reducing agent as described in Japanese Patent Application (OPI) No. 139,724/75 (corresponding to U.S. Ser. No. 461,172, filed April 15, 1974), but contains an ultraviolet light-absorbing agent. Therefore, it is stable light, and has the advantage that an image can be obtained in a dry process. In addition, it has the advantage that the electric potential applied upon imagewise passing of an electric current between the electrically conductive layers of the photoelectric sensor and the image-recording layer is not more than about 150 V, preferably not more than 80 V, most preferably not more than 20 V, generally not lower than about 0.8 V.

The apparatus and the image-forming process of the present invention will be illustrated by reference to attached drawings.

Figure 2:
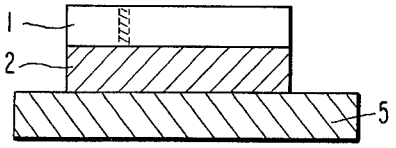
FIG. 2 is a schematic view showing heat development according to one embodiment of the present invention.

Firstly, FIGS. 1 and 2 show an embodiment of the present invention. In this embodiment, image-recording layer 1 is provided on a grounded electrically conductive support 2. A current is passed through this image-recording layer 1 through the tip of metal needle 3. In this case, the voltage potential across the tip of metal needle 3 and support 2 is raised to a particular level using power supply 4, and the needle 3 is moved in contact with the surface of image-recording layer 1. After image-recording layer 1 is brought into contact with needle 3, a current passes in the area in contact with the needle, and a developable pattern (or a latent image) is formed in the area. The electric charge density to be formed through the needle in the area of the image-recording layer contacted by the needle need not necessarily be sufficient to cause a visible image to be formed. However, this electric charge density must be sufficient to form a latent image in the area contacted by the needle. One specific example for generating an imagewise current flow in image-recording layer 1 is described above, but it is of course possible in the present invention to employ techniques generally known in this field, and the present invention includes techniques. Such techniques include a process of contacting a stencil to which an electric potential is applied with image recording layer 1, and scanning layer 1 with an electron beam.

Then, in order to develop the latent image formed in the image-recording layer using one of the above-described processes, the image-recording material is brought into contact with heating metal plate 5. Additionally, the plate used here functions to substantially uniformly heat the entire image-recording layer 1. It is also possible to contact one of the flat surfaces of the image-recording material with plate 5 in order to develop the latent image. After heating the image-recording layer to a sufficient temperature to convert the latent image into a visible image for a definite time, the image-recording layer is removed from contact with heating plate 5.

Figure 3:
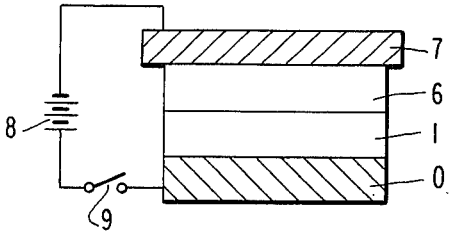
FIG. 3 is a schematic view showing the method for passing a electric current according to one embodiment of the present invention.

FIG. 3 shows another embodiment of the present invention. Image-recording layer 1 and photoelectric translating element 6, preferably photoconductive layer 6, are provided between a pair of electrically conductive supports 7 and 0. Additionally, the photoelectric sensor comprises photoconductive layer 6 and conductive support 7. In this case, an electric field is formed across the above-described photoconductive layer and the image-recording layer by connecting conductive supports 7 and 0 to DC electrical current supply 8. Photoconductive layer 6 is advantageously selected so that the relative electric resistance betweeen image-recording layer 1 and photoconductive layer 6 at the operating voltage in the present invention falls within a suitable range. The electric characteristics of the photoconductive layer and the image-recording layer may be non-linear. Therefore, as photoconductive layer 6, it is preferable to select a photoconductive layer which has about the same resistance as that of the image-recording layer within the operating voltage of the present invention. A latent image formed by passing an electric current is produced through imagewise exposure of photoconductive layer 6 to actinic radiation via transparent electrically conductive layer 7. Such exposure processing selectively improves the electric conductivity of the photoconductive layer in the areas exposed to actinic radiation. An electrical current flow is imagewise generated through the image-recording layer by imagewise exposing while closing the switch 9. Such an electric current flow is generated in the portions of the image-recording layer corresponding to the exposed portions of the photoconductive layer, the image-recording layer being provided juxtaposed in line with the exposed portions of the photoconductive layer. An electric charge density of about 50 mc/cm$^2$, preferably 5 mc/cm$^2$, is generated in the exposed portions of the image-recording layer, and subsequently switch 9 is opened to stop the electric current flow. Then, image-recording layer 1 is separated from photoconductive layer 6 and contact therebetween broken, followed by substantially uniformly heating the image-recording layer in order to convert the latent image present in layer 1 to a visible image. This heat-processing is conducted by placing the image-recording layer and heating metal plate 5 in such a relation that heat transfer is ensured. Upon heating the entire image-recording layer, the latent image present in the image-recording layer is rendered visible.

Finally, the image-recording layer is separated from the plate.

What must be specially mentioned here is that, in the above-described embodiment of the present invention, application of an electric potential across the photoconductive layer and the image-recording layer to conduct an electric current in an imagewise manner can be attained by using various techniques known in this field.

Figure 4:
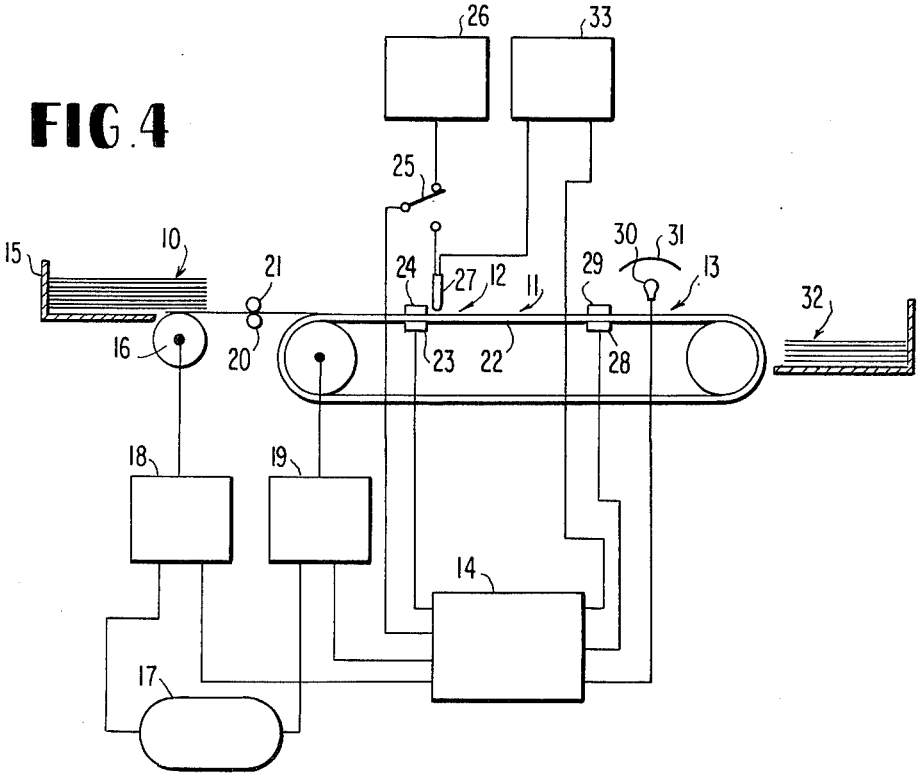
FIG. 4 shows a flow sheet of an image-recording apparatus for practicing the process of the present invention.

Referring to FIG. 4, FIG. 4 shows a specific embodiment of a recording apparatus for forming visible images in the image-recording material of the present invention. This recording apparatus generally includes supply hopper 10, transfer member 11, exposure area 12, processing area 13 and control circuit 14. In operating this apparatus, many image-recording materials are loaded in a stacked condition on feeding shelf 15 of supply hopper 10. Carrying roller 16 extends through the opening formed in feeding shelf 15, and abrasively contacts the lowermost image-recording material in the stack. Upon operating the apparatus by pushing a starting button (not shown), control circuit 14 actuates motor 17 and clutches 18 and 19. These clutches function to connect the driving force from motor 17 to carrying roller 16 and transfer member 11, respectively.

The image-recording materials are fed one by one from the bottom of the stack with carrying roller 16 through a pair of separator rollers 20 and 21 onto electrically conductive heat-resistant conveyer belt 22. Since the image-recording material moves along conveyer belt 22, a means for detecting the arrival of the leading end to exposure area 12 is provided. This detecting means contains microswitch 23, which is provided and disposed so that the leading end of the image-recording material closes the contacts 24 of microswitch 23 when the image-recording material passes there. When contacts 24 are closed, a signal is generated corresponding thereto, and the signal is sent to control circuit 14. Upon reception of the signal, curcuit 14 disengages the action of clutch 18, thus stopping the image-recording material at exposing area 12.

The control circuit then closes switch 25 which connects electric power source 26 to metal needle 27, to thereby apply an electric potential to the needle with respect to conveyer belt 22. This control circuit then acts on logic apparatus 33 for driving the needle to actuate logic apparatus 33. This needle-driving logic apparatus drives moving needle 27 in contact with the image-recording layer in accordance with the image pattern to be recorded. When the needle is contacted with the image-recording layer, a current is passed in the areas of the image-recording layer which are contacted with the needle, to form a developable pattern of nuclei (or a latent image) on the recording layer. The electric charge density to be formed with needle 27 in the areas of the image-recording layer contacted by the needle need not necessarily be sufficient to cause a visual image (or visual change) to be formed. However, this electric charge density must be sufficient to form a latent image in the image-recording material, particularly in the areas contacted with the needle.

In order to develop the latent image formed in the image-recording layer, control circuit 14 actuates clutch 19 to again connect the driving force from motor 17 to conveyor belt 22. Since the image-recording material moves along conveyer belt 22, a means for detecting the arrival of the leading end of the image-recording material to processing area 13 is provided. This detecting means contains second microswitch 28, which is provided and disposed so that the leading end of the image-recording meaterial closes contacts 29 of microswitch 28 when the image-recording material passes therethrough. When contacts 29 are closed, a signal is generated corresponding thereto. This signal is then sent to control circuit 14. Upon reception of the signal, control circuit 14 disengages the action of clutch 68 to stop the image-recording material at processing area 13. The control circuit then actuates heating means 30. This heating means is, for example, an infrared lamp surrounded by reflection plate 31, and substantially uniformly heats the entire image-recording layer. After heating the image-recording layer up to a temperature high enough to convert the latent image into a visible image for a definite time, control circuit 14 again actuates clutch 19 to transmit the driving force from motor 17 to conveyor belt 22, and thus the image-recording material is sent to receiving hopper 32.

It is easy, if desired, to modify the above-described apparatus so that a continuous operation is possible. In order to attain such an effect, control circuit 14 is modified so that transfer member 11 is continuously connected to driving motor 17, and exposure area 12 is also modified so as to contain many needles. In this case, needles can be selectively moved as the image-recording material moves.

This specification describes the use of a specific technique for this recording apparatus in order to imagewise generate an electrical current flow. However, it is, of course, possible to utilize other techniques generally known in this technical field, and the present invention includes their use. Such known techniques include, for example, the use of a photoelectric sensor, bringing a stencil to which an electric potential is applied into contact with the image-recording layer, and scanning the image-recording layer using an electron beam. Similarly, heating of the image-recording layer can be achieved by utilizing other techniques known in this technical field, for example, by guiding the image-recording layer onto a heating plate or around a heating roller.

The image-recording material and the image-recording process of the present invention has advantages such as visible images can be recorded in a dry process, visible images with a high optical density can be recorded with a small current due to amplification, the recording material can be processed in a bright room except when the processing is by applying an electric potential in contact with a photoconductive material, it enables the further recording, after initially recording an image by imagewise conducting an electric current and heating, another image thereon by imagewise conducting another electric current in the same recording material, i.e., enables add-on recording to be conducted, and, with the image-recording material having an electron-sensitive composition containing an ultraviolet light-absorbing agent, the phenomenon of coloration in the non-image areas (light fog) does not substantially occur even when it is left in a bright room after formation of visible images. Thus, they possess remarkable utility in the image-copying field.

The following examples are given to illustrate the present invention in greater detail. Unless otherwise indicated herein all parts, percents, ratios and the like are by weight.

EXAMPLE 1

60 mg of $Co(NH_3)_6(CF_3COO)_3$, 18 mg of 1-(2-pyridyl-azo)2-naphthol and 0.4 g of dimethylstearamide were dissolved in a solution prepared by dissolving 0.6 g of polyvinyl butyral (tradename: DENKA BUTYRAL 4000-2; made by Electric Chemical Industrial Co., Ltd.; solution viscosity [10 wt % in a mixed solvent of ethanol:toluene = 1:1 (by volume), 20° C.]: 180–240 cps; mean polymerization degree: about 100; composition: 75 wt % or more polyvinyl butyral, 18–22 wt % polyvinyl alcohol and 3.0 wt % or less polyvinyl acetate) in 6 ml of ethyl alcohol. This solution was coated on a glass plate (NESA glass; surface resistance: 2,000 ohm/cm) coated with $SnO_2$ on the surface, using a Meyer bar #60 in a dry thickness of 8.7 μm.

Cu was heat-diffused into a CdS signal crystal, and Au was vacuum-deposited on one side thereof in a thickness of 40 nm, and $In_2O_3$ on the other side in a thickness of 50 nm to prepare a transparent electrode element. This element allowed a current of 100 $mA.cm^{-2}$ to flow with light of a wavelength of 500 nm in an amount of $1.95 \times 10^{13}$ $photon.cm^{-2}.S^{-1}$. The above-described image-recording layer was closely contacted with this element and, while applying an electric potential of 3 V with $SnO_2$ as the negative electrode and $In_2O_3$ as the positive electrode, imagewise exposed with light of a wavelength of 500 nm for 0.5 second. Image formation was difficultly observed. Upon heating this for 30 seconds at 100° C., a blue image was formed with a yellow background.

EXAMPLE 2

An image layer having the same composition as in Example 1 was coated on NESA glass.

40 g of tetragonal lead oxide, 8 g of a styrene (85% by weight)-butadiene (15% by weight) copolymer resin (tradename: Pliolite S-5; made by Goodyear Tire and Rubber Co.) and 48 g of toluene were kneaded for 24 hours using a ball mill. After filtering through a polyester screen (20 mesh), it was coated in a dry thickness of 90 μm on a polyester film support having $In_2O_3$ vacuum-deposited thereon.

The film-coated surfaces were contacted with each other, and the PbO-coated $In_2O_3$ layer was made the anode and the image layer-coated $SnO_2$ layer the cathode. An electric potential of 100 V was applied across both electrodes and, at the same time, the material was exposed to X-rays. The X-ray source was an X-ray apparatus, Hitach MN-S-10 P, for industrial use, operated at 100 kVp and 5 mA. Application of the electric potential to the photoconductor and simultaneous imagewise exposure thereof were continued for 8 seconds, then the image layer and the PbO layer were separated from each other in a dark place. Upon heating the image layer for 30 seconds at 120° C., a blue image was formed with a yellow background.

EXAMPLE 3

55 mg of $Co(NH_3)_6(ClO_4)_3$, 15 mg of 2-(2-pyridyl-azo)resorcinol, 0.6 g of cellulose acetate butyrate and 6 ml of acetone were mixed and stirred to dissolve. This was coated on an $In_2O_3$-deposited polyester film using a Meyer bar #60 to form an image layer.

$In_2O_3$ was vacuum-deposited on a polyester support, and CdS was sputtered thereon in a thickness of 500 nm. This CdS element and the image layer were closely contacted with each other and, while applying an electric potential of 4 V across both $In_2O_3$ layers, light of a wavelength of 500 nm and 1,000 lux was used for imagewise exposure for 1.5 seconds. The image layer was separated from the CdS element, and the image layer was heated for 30 seconds at 100° C. The image, which had a low density immediately after irradiation, became a reddish brown image with a yellow background. Additionally, in another measurement, a photo current was measured by irradiating light of a wavelength of 500 nm and 1,000 lux with gold vacuum-deposited on the above-described CdS element as the anode and $In_2O_3$ as the cathode, and a value of 1 $mA/cm^2$ was obtained.

EXAMPLE 4

The same image layer as described in Example 1 was contacted with a platinum needle, and an AC electric potential of 100 V was applied across the platinum needle and the $SnO_2$ layer, and the platinum needle was moved at a rate of 20 cm/sec. Then, the platinum needle was removed. A light colored image was observed. Upon heating at 100° C. for 15 seconds, a blue image was formed with a yellow background. When the platinum needle was moved at a rate of 5 cm/sec., a quite dark blue image was formed after removing the platinum needle.

EXAMPLE 5

The same image layer as described in Example 4 was contacted with a stainless steel needle, and the stainless steel needle was moved at a rate of 20 cm/sec. while applying a DC electric potential of 20 V with the stainless steel as the anode and the $SnO_2$ layer as the cathode. After removing the stainless steel needle, an image with an extremely light colored density was formed. Upon heating this at 120° C. for 10 seconds, a blue image was formed with a yellow background.

EXAMPLE 6

60 mg of tris(1,3-propanediamine)cobalt (III) trifluoroacetate, 20 mg of 1,3-diphenyl-5-(2-pyridyl)-formazan, 0.6 g of polyvinyl butyral (tradename: DENKA BUTYRAL 4000-2; made by Electric Chemical Industry Co., Ltd.) and 6.0 ml of ethanol were dissolved and coated on a $SnO_2$-coated glass (NESA glass) using a Meyer bar #60 to prepare an image layer. This was contacted with the same CdS layer as described in Example 1 with the film-coated surfaces facing each other. Then, the composite was exposed with light of a wavelength of 436 nm and 100 lux for 2 seconds while applying a DC electric potential of 5 V across the electrodes with the $SnO_2$ layer as the cathode and the $In_2O_3$ layer as the anode. Then, the image layer was separated from the CdS layer. No images were observed. Upon heating at 100° C. for 30 seconds, a green image was distinctly observed with a yellow background.

EXAMPLE 7

60 mg of hexamminecobalt (III) trifluoroacetate, 12 mg of 1-(2-pyridyl-azo)-2-naphthol, 0.6 g of polyvinyl alcohol (tradename: DENKA BUTYRAL #4000-2) and 6 ml of ethyl alcohol were mixed and stirred to dissolve. This was coated on a $SnO_2$-coated glass plate in a dry thickness of 9 μm using a Meyer bar #60, followed by drying. This was used as an image layer.

37.5 g of toluene was added to 25 g of a light-sensitive agent containing ZnO as a photoconductive material (in a paste form; tradename: EPM Light-Sensitive Agent #500-3; made by Nippon Oils & Fats Co., Ltd.). This coating solution was coated on an $In_2O_3$-deposited polyester film (surface resistance: 1.2 kΩ/cm) using a spinner (made by TAKAHASHI SEIKI KOGYO), and dried to form a photoconductive layer. Thus a photoelectric sensor was prepared.

The image layer was closely contacted with the photoconductive layer with the film-coated surfaces facing each other. Imagewise exposure was conducted for 60 seconds using light from a super-high pressure mercury lamp (500 W; made by Ushio Electric Inc.) while applying an electric potential of 5 V across both electrodes with the $SnO_2$ layer as the cathode and the $In_2O_3$ layer as the anode. When the image layer was separated from the photoconductive layer, no images were observed. Upon heating this at 110° C. for 25 seconds, a blue image was formed with a yellow background.

EXAMPLE 8

An electron-sensitive composition of the following formulation (Composition 8);

| | |
|---|---|
| $[Co(NH_3)_6](CF_3COO)_3$ | 60 mg |
| 1-(2-Pyridylazo)-2-naphthol | 12 mg |
| N,N-Dimethylstearamide | 0.4 g |
| 2,4-Dihydroxybenzophenone | 10 mg |

was dispersed in an ethanol solution of polyvinyl butyral having the following formulation;

| | |
|---|---|
| Polyvinyl Butyral*1 | 0.48 g |
| Ethanol | 6 ml |

(Note)
*1DENKA BUTYRAL 4000-2, made by Electric Chemical Industrial Co., Ltd.

to prepare an electron-sensitive composition solution. Then, this solution was coated on a glass plate (NESA glass; surface resistance: 200 ohm/cm$^2$) whose surface had been coated with $SnO_2$, using a Meyer bar #60, then dried to prepare a recording material (Sample 8). The dry film thickness of the electron-sensitive composition layer was 5.5 μm.

COMPARATIVE EXAMPLE 1

An electron-sensitive composition having the following formulation (Comparative Composition 1);

| | |
|---|---|
| $[Co(NH_3)_6](CF_3COO)_3$ | 60 mg |
| 1-(2-Pyridylazo)-2-naphthol | 12 mg |
| N,N-Dimethylstearamide | 0.4 g |

was dissolved in the same polyvinyl butyral-ethanol solution as described in Example 8, and a recording material (Comparative Sample 1) was prepared in the same manner as described in Example 8.

Then, the above Sample 8 and Comparative Sample 1 were exposed for 500 counts using a spectral irradiator (concave grating mounting irradiator made by Japan Spectroscopic Co., Ltd.), then the print-out density was measured to obtain the results shown in Table 1 below.

Table 1

| Wave-length of Irradiated UV Light | Print-out Optical Density | |
|---|---|---|
| | Sample 8 | Comparative Sample 1 |
| (nm) | | |
| 333 | 0.14 | 0.36 |
| 350 | 0.12 | 0.14 |
| 366 | 0.10 | 0.08 |

The smaller the print-out optical density, the less the formation of fog with the lapse of time.

On the other hand, copper was heat-diffused into a CdS single crystal, and gold was vacuum-deposited on the one side in a thickness of 40 nm and $In_2O_3$ on the other side in a thickness of 50 nm to prepare a transparent electrode element (photoelectric sensor) (Photoelectric Sensor 8). This photoelectric sensor passed an electric current of 100 mA.cm$^{-2}$ when exposed with light of a wavelength of 500 nm in an amount of $1.95 \times 10^3$ photon.cm$^{-2}$.S$^{-1}$.

The gold-deposited surface of Photoelectric Sensor 8 was closely contacted with the electron-sensitive composition layer of Sample 8 or Comparative Sample 1, and imagewise exposed for 5 seconds through an original image and the photoelectric sensor using a light of a wavelength of 500 nm while applying a DC electric potential of 3 V across the two layers with connecting the $SnO_2$ layer to the negative electrode and the $In_2O_3$ layer to the positive electrode. An image difficultly observable with the naked eye resulted. Then, the photoelectric sensor was separated, and the sample alone was heated at 100° C. for 30 seconds to form a blue image with a yellow background. The optical densities of the image and the background were as shown in Table 2 below.

| Sample | Optical Density Immediately After Heating | |
|---|---|---|
| | Blue Image | Yellow Background |
| Sample 8 | 0.29 | 0.07 |
| Comparative Sample 1 | 0.24 | 0.08 |

Then, the samples were left for 1 week in a room exposed to sunlight and a fluorescent lamp. After one week, the color tone and density of the yellow background of Sample 8 were substantially unchanged, whereas those of Comparative Sample 1 were changed to a yellowish green with an increased density.

EXAMPLES 9-14

Electron-sensitive compositions having the following formulations (Compositions 9-14);

| | |
|---|---|
| $[Co(NH_3)_6](CF_3COO)_3$ | 60 mg |
| 1-(2-Pyridylazo)-2-naphthol | 12 mg |
| N,N-Dimethylstearamide | 0.4 g |
| UV Light-Absorbing Agent (shown in Table 3) (ethanol solution) | Table 3 |

were dissolved in the same polyvinyl butyral-ethanol solution as described in Example 8 to prepare electron-sensitive composition solutions.

Table 3

| Ex. No. | UV Light-Absorbing Agent | Solvent | Concentration (wt %) | Amount Added (ml) |
|---|---|---|---|---|
| 9 | UVINUL N-35*(2) | Ethanol | 1.0 | 0.1 |
| 10 | UVINUL N-35 | Ethanol | 1.0 | 1.0 |
| 11 | Phenyl salicylate | Ethanol | 1.0 | 0.1 |
| 12 | Phenyl salicylate | Ethanol | 1.0 | 1.0 |
| 13 | UVINUL MS-40*(3) | Ethanol | 1.0 | 0.1 |
| 14 | UVINUL MS-40 | Ethanol | 1.0 | 1.0 |

*(2)1,1-Diphenyl-2-cyano-2-ethoxycarbonyl-ethylene, made by Antara Chemical Co.
*(3)tradename of 2-hydroxy-4-methoxy-4-methoxybenzophenone, made by Antara Chemical Co.

Then, each of the above-described electron-sensitive composition solutions was coated on the same NESA glass as described in Example 8, and dried to prepare image-recording materials (Samples 9-14).

Then, Samples 9–14 were exposed in the same manner as described in Example 9 using a spectral irradiator as used in Comparative Example 1 to measure the print-out optical density. Also, Samples 9–14 and Comparative Sample 1 were contacted with an electrically conductive rubber (made by The Shin-etsu Chemical Industry Co., Ltd.); thickness: 1.4 mm; electric resistance between the surface and the back; 100 ohm), of a size of 1.0 cm × 1.0 cm and a DC electric potential of 5 V was applied across both layers by connecting the $SnO_2$ layer to the negative electrode and the conductive rubber layer to the positive electrode, to measure the electric amount. Then, the samples were separated from the conductive rubber, and heated at 100° C. for 40 seconds to measure the optical density in the area contacted with the conductive rubber (1.0 cm × 1.0 cm) (image) and fog optical density in the remaining area (background). The results obtained are shown in Table 4 below.

Table 4

| Sample No. | Image Optical Density | Fog Optical Density | Print-out Optical Density 333 nm | 350 nm | 366 nm |
|---|---|---|---|---|---|
| 9 | 0.24 | 0.06 | 0.22 | 0.13 | 0.08 |
| 10 | 0.30 | 0.06 | 0.25 | 0.11 | 0.08 |
| 11 | 0.30 | 0.10 | 0.36 | 0.15 | 0.08 |
| 12 | 0.28 | 0.07 | 0.21 | 0.13 | 0.06 |
| 13 | 0.34 | 0.09 | 0.28 | 0.16 | 0.10 |
| 14 | 0.11 | 0.08 | 0.12 | 0.08 | 0.08 |
| Comparative Sample 1 | 0.29 | 0.07 | 0.36 | 0.14 | 0.08 |

Print-out optical density corresponds well to fog optical density upon exposure to sunlight.

Sample 14 containing an ultraviolet light-absorbing agent having anionizable substituent in a large amount showed a low print-out density (i.e., low fog) but, at the same time, the optical density of the image was low.

EXAMPLES 15 and 16

Electron-sensitive compositions having the following formulations (Compositions 15 and 16);

| | |
|---|---|
| $[Co(NH_3)_6]$ $(CF_3COO)_3$ | 60 mg |
| 1-(2-Pyridylazo)-2-naphthol | 24 mg |
| N,N-Dimethylstearamide | 0.4 g |
| UV Light-Absorbing Agent (described below) | given below |

KIND AND AMOUNT OF UV LIGHT-ABSORBING AGENTS (Example 15)

2-(2-Hydroxy-5-methylphenyl)benzotriazole
1.0 ml of a 1.0 wt % ethyleneglycol monomethyl ether solution (Example 16)

2-(2-Hydroxy-3-tert-butyl-5-methylphenyl)benzotriazole
1.0 ml of a 1.0 wt % ethyleneglycol monomethyl ether solution
Polyvinyl Butyral: 0.48 g
Ethanol: 6 ml were used, and recording materials (Samples 15 and 16) were prepared in the same manner as described in Example 8.

COMPARATIVE EXAMPLE 2

A recording material (Comparative Sample 2) was prepared in the same manner as described in Example 8, except for using an electron-sensitive composition having the following formulation (Comparative Composition 2);

| | |
|---|---|
| $[Co(NH_3)_6]$ $(CF_3COO)_3$ | 60 mg |
| 1-(2-Pyridylazo)-2-naphthol | 24 mg |
| N,N-Dimethylstearamide | 0.4 g |

Then, the print-out optical density of Samples 15, 16 and Comparative Sample 2 was measured in the same manner as in Example 8, and the image optical density and fog optical density were measured in the same manner as in Example 9 to obtain the results shown in Table 5 below.

Table 5

| Sample | Image Optical Density | Fog Optical Density | Print-out Optical Density 333 nm | 350 nm | 360 nm |
|---|---|---|---|---|---|
| Sample 15 | 0.49 | 0.08 | 0.22 | 0.12 | 0.10 |
| Sample 16 | 0.49 | 0.10 | 0.28 | 0.14 | 0.10 |
| Comparative Sample 2 | 0.54 | 0.09 | 0.33 | 0.15 | 0.12 |

EXAMPLE 17

An electron-sensitive composition solution having the following formulation (Composition Solution 17);

| | |
|---|---|
| $[Co(NH_3)_6]$ $(CF_3COO)_3$ | 40 mg |
| 1-(2-Pyridylazo)-2-naphthol | 16 mg |
| N,N-Dimethylstearamide | 0.28 g |
| Polyvinylbutyral (8 wt % ethanol solution) | 4 g |
| 2,4-Dihydroxybenzene (1 wt % ethyleneglycol monomethyl ether solution) | 0.5 ml |
| 2-(2-Hydroxy-3,5-di-tert-butylphenyl)-6-chlorobenzotriazole (1 wt % ethylene glycol monomethyl ether solution) | 0.5 ml |

was stirred to dissolve, and this solution was coated in a dry thickness of about 5 μm on a 6 nm thick-$In_2O_3$ layer vacuum-deposited on a 100 μm-thick polyethylene terephthalate (PET) film using a Meyer bar #60, and dried to obtain an image-recording material (Sample 17).

Sample 17 and Comparative Sample 2 were exposed to the direct rays of the sun on a clear day for 2 hours and 30 minutes (from 10:50 to 13:20 on Dec. 4th, 1976 at Asaka City, Saitama, Japan) in such a manner that the areas exposed to sun-light and areas unexposed to sun-light were formed, respectively. Thus, the results shown in Table 6 were obtained.

Table 6

| Sample | Optical Density in the Area Exposed to Direct Rays of the Sun | Optical Density of Unexposed Area |
|---|---|---|
| Sample 17 | 0.25 | 0.08 |
| Comparative Sample 2 | 0.37 | 0.08 |

Also, Sample 17 and Comparative Sample 2 were exposed for 500 counts using the same spectral irradiator as described in Example 17 to measure the print-out optical density. The results obtained are shown in Table 7 below.

Table 7

| Sample | Print-out Optical Density | | |
|---|---|---|---|
| | 333 nm | 350 nm | 366 nm |
| Sample 17 | 0.16 | 0.12 | 0.08 |
| Comparative Sample 2 | 0.33 | 0.15 | 0.12 |

EXAMPLE 18

An electron-sensitive composition solution of the following formulation (Composition Solution 18);

| | |
|---|---|
| tris(1,3-Propanediamine)cobalt (III) Trifluoroacetate | 60 mg |
| 1,3-Diphenyl-5-(2-pyridyl)formazan | 20 mg |
| 2,2'-Dihydroxy-4,4'-dimethoxy-benzophenone | 8 mg |
| Polyvinyl Butyral (same aas in Ex. 1) | 0.6 g |
| Ethanol | 6.0 ml |

was stirred to dissolve, and an image-recording material (Sample 18) was prepared in the same manner as in Example 8. Then, in the same manner as in Example 8, Sample 18 was closely contacted with the same photoelectric sensor as used in Example 8, and imagewise exposed for 2 seconds using a light of a wavelength of 436 nm and 100 lux in illuminance while applying a DC electric potential of 5 V. No images were observed with the naked eye. Then, the sample was separated from the photoelectric sensor, and heat-developed at 100° C. for 40 seconds. Thus, a green image was distinctly observed with a yellow background. After the heat-developed Sample 18 was left for 1 week in a room lighted with sun-light and a fluorescent lamp, no substantial change occurred in the yellow background.

COMPARATIVE EXAMPLE 3

An electron-sensitive composition solution having the same formulation as in Example 18 except that it did not contain 2,2'-dihydroxy-4,4-dimethoxybenzophenone was prepared, and a recording material (Comparative Sample 3) was prepared using it in the same manner as in Example 18. When the recording material was subjected to the same processing as in Example 18, the background was changed to green with an increased density 1 week after the heat development.

EXAMPLE 19

A recording material (Sample 19) was prepared in the same manner as in Example 18 except for using hexamminecobalt (III) triperchlorate, $[Co(NH_3)_6](ClO_4)_3$, in place of tris(1,3-propanediamine)cobalt (III) trifluoroacetate in the same amount, and 0.48 g of polyvinyl butyral and 6 ml of ethanol.

COMPARATIVE EXAMPLE 4

A recording material (Comparative Sample 4) was prepared in the same manner as in Example 18 except for using hexamminecobalt (III) triperchlorate in place of tris(1,3-propanediamine)cobalt (III) trifluoroacetate and not using 2,2'-dihydroxydimethoxybenzophenone.

Then, Sample 19 and Comparative Sample 4 were processed in the same manner as in Example 19 to obtain the same results as in Example 18. After leaving the processed samples in a room under the same conditions as in Example 18, no substantial changes in the background in Sample 19 occurred, whereas the background in Comparative Sample 4 was changed to a yellowish green with increased density.

While the invention has been described in detail and with reference to specific embodiments thereof, it will be apparent to one skilled in the art that various changes and modifications can be made therein without departing from the spirit and scope thereof.

What is claimed is:

1. An image-recording process for recording images by using a recording material comprising a support, at least the surface of which is electrically conductive, with this electrically conductive surface having thereon an electron-sensitive composition layer substantially containing a trivalent cobalt complex compound, a compound having a conjugated $\pi$ bond system capable of forming at least a bidentate ligand with a divalent or trivalent cobalt ion and a binder as an image-recording layer, which process comprises the steps of:
   (1) imagewise generating in said image-recording layer sufficient electric current to form a latent image; and
   (2) reducing said trivalent cobalt complex compound in the areas wherein the electric current has passed in step (1) by substantially uniformly heating at least said image-recording layer.

2. The image-recording process as described in claim 1, wherein said image-recording material further includes a photoelectric sensor layer on said image-recording layer.

3. The image-recording process as described in claim 2, including applying an electric potential of about 0.8 to about 150 volts between the photoelectric sensor and the image-recording layer.

4. The image-recording process as described in claim 1, wherein said electron-sensitive composition further contains at least one compound capable of absorbing electromagnetic waves of a wavelength not longer than 350 mm as an ultraviolet light absorbing agent.

5. The process as described in claim 4, wherein said ultraviolet light-absorbing agent has at least one member selected from the group consisting of 2-hydrocybenzophenone, 2-(2-hydroxyphenyl)benzotriazole, phenyl salicylate, resorcinol monobenzoate, $\alpha$-cyano-$\beta$,$\beta$-diphenylacrylic acid, the derivatives thereof substituted with substituents substantially incapable of forming anions, and dibenzoylresorcinols.

6. An image-recording process for forming visible images using an image-recording material comprising a support, at least the surface of which is electrically conductive, having on said electrically conductive surface a layer of an electron-sensitive composition substantially containing (a) a trivalent cobalt complex compound, (b) a compound having a conjugated $\pi$ bond system capable of forming at least a bidenate ligand with a divalent or trivalent cobalt ion, (c) a binder and (d) a compound capable of absorbing electromagnetic waves of a wavelength not longer than about 350 nm as an ultraviolet light absorbing agent, which comprises:
   imagewise passing sufficient electric current in said electron-sensitive composition layer to form a latent image or a primitive visible image, and heating at least said electron-sensitive composition layer to thereby reduce said trivalent cobalt complex compound in the areas of said electron-sensitive composition layer where said latent or primitive visible image has been formed, thus a visible image with a higher optical density in conformity with said latent or primitive visible image being formed in said electron-sensitive composition layer.

7. The process as described in claim 6, wherein the imagewise passing of sufficient electric current to form a latent image or a primitive visible image in said electron-sensitive composition layer comprises imagewise contacting an electrically conductive material with the surface of said electron-sensitive composition layer, or contacting the surface of an electrically conductive material carrying an image on the surface of said electron-sensitive composition, and applying an electric potential across said electrically conductive material and said electrically conductive support.

8. The process as described in claim 6, wherein said ultraviolet light-absorbing agent is at least one member selected from the group consisting of 2-hydroxybenzophenone, 2-(2-hydroxyphenyl)benzotriazole, phenyl salicylate, resorcinol monobenzoate, α-cyano-β,β-diphenylacrylic acid, the derivatives thereof substituted with substituents substantially incapable of forming anions, and dibenzoylresorcinols.

* * * * *

UNITED STATES PATENT AND TRADEMARK OFFICE

CERTIFICATE OF CORRECTION

PATENT NO. : 4,131,463

DATED : December 26, 1978

INVENTOR(S) : Masayoshi TSUBOI et al

It is certified that error appears in the above-identified patent and that said Letters Patent are hereby corrected as shown below:

IN THE HEADING:

Foreign Application Priority Data:

Add -- Feb. 17, 1977 Japan .....16370/77 --

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*